US007975636B2

(12) United States Patent
Ulgen

(10) Patent No.: US 7,975,636 B2
(45) Date of Patent: Jul. 12, 2011

(54) MECHANISM FOR CONTROLLING DROPPING DOWN AND PICKING UP OF AN ANCHOR TO AND FROM THE WATER

(76) Inventor: Mehmet Nevres Ulgen, Istanbul (TR)

( * ) Notice: Subject to any disclaimer, the term of this patent is extended or adjusted under 35 U.S.C. 154(b) by 158 days.

(21) Appl. No.: 12/371,795

(22) Filed: Feb. 16, 2009

(65) Prior Publication Data

US 2010/0206209 A1 Aug. 19, 2010

(51) Int. Cl.
*B63B 21/22* (2006.01)

(52) U.S. Cl. ..... 114/210

(58) Field of Classification Search ..... 114/210, 114/230.1, 230.2, 230.23, 230.26, 230.28, 114/230.29, 230.3, 204, 205, 213, 215–217
See application file for complete search history.

(56) References Cited

U.S. PATENT DOCUMENTS

| | | | | | |
|---|---|---|---|---|---|
| 1,749,193 | A | * | 3/1930 | Schauman et al. | 114/210 |
| 1,799,257 | A | * | 4/1931 | Schauman | 114/210 |
| 3,025,821 | A | * | 3/1962 | Robinson | 114/210 |
| 3,261,319 | A | * | 7/1966 | Ellis | 114/210 |
| 3,704,680 | A | * | 12/1972 | Uher | 114/210 |
| 4,248,171 | A | * | 2/1981 | Barbour | 114/210 |
| 4,526,123 | A | * | 7/1985 | van den Haak | 114/210 |

* cited by examiner

*Primary Examiner* — Daniel V Venne
(74) *Attorney, Agent, or Firm* — Vidas, Arrett & Steinkraus

(57) ABSTRACT

A mechanism for dropping down and picking up an anchor in a controlled manner, the anchor having a chain with one end connected to a capstan in a releasable and retractable manner, an arm section to which the chain is connected from its other end, and a tip section, the mechanism of the present invention comprises a movable carrier which guides the anchor a certain distance as the anchor leaves the marine vehicle and is picked up onto the same.

2 Claims, 3 Drawing Sheets

MECHANISM FOR CONTROLLING DROPPING DOWN AND PICKING UP OF AN ANCHOR TO AND FROM THE WATER

CROSS-REFERENCE TO RELATED APPLICATIONS

Not applicable

STATEMENT REGARDING FEDERALLY SPONSORED RESEARCH

Not applicable

BACKGROUND OF THE INVENTION

Present invention relates to a mechanism devised for the control of an anchor immobilizing the overwater location of a marine vehicle while dropping down to water and picking up same from water.

BACKGROUND OF INVENTION

Anchors connected from one end to marine vehicles by means of chains are used in marine vehicles, such as boats, vessels etc. for immobilizing the location of same over shallow waters. Anchor is dropped down to water by releasing the chain wrapped around a capstan drum, whereas the anchor is picked up from the water by the reverse rotation of the capstan drum to wrap the chain around the drum.

An anchor of such configuration comprises a front tip part in the form of a plough or a digger to hold the bottom of the sea, an arm section having a longitudinal shape, and a chain connected to the capstan drum from one end of the arm.

The capstan drum, the chain and the anchor when wrapped around the drum are typically disposed on the deck at the front tip part of marine vehicle. When the anchor is dropped down to the water or picked up from the water, the arm section, and in particular the end part of the arm of the anchor to which the chain is fastened, exhibits an arch-like movement. This is because, before the anchor arm to which the chain is connected is dropped down to the water, the anchor extends substantially in horizontal direction, but when it is started to drop down the anchor into water, the anchor changes its direction from horizontal to vertical, and the end part of the arm to which the chain is connected performs an arch-like movement which leads to sweeping a significant extent of area and volume as the anchor changes its direction from horizontal to vertical plane. Due to the existence of this sweeping area and volume, the anchor system is disposed so as to keep it as possible as far downwards on the deck in marine vessels, this in turn results several disadvantages such as the reduction of potentially usable area on the deck, and possible accidents which the operators may face during operation.

SUMMARY OF INVENTION

The object of the present invention is to avoid the circumstances in which the operators may face accidents and to gain space on the marine vehicle's deck by both controllably dropping down to and picking up from the water the aforementioned type of anchors, and by disposing anchor device as possible in horizontal direction as under the deck.

In an attempt to achieve the above-mentioned object, the present invention provides a mechanism for dropping down and picking up an anchor in a controlled manner, the anchor having a chain with one end connected to a capstan in a releasable and retractable manner, an arm section to which the chain is connected from its other end, and a tip section, the mechanism of the present invention comprises a movable carrier which guides the anchor a certain distance as the anchor leaves the marine vehicle and is picked up onto the same.

The mechanism of the present invention further comprises a bearing that bears the movable carrier.

The movable carrier in the mechanism according to the present invention is born by the bearing by means of pins movable in openings formed along the bearing and the movable carrier is preferably driven by means of a piston.

DESCRIPTION OF PARTS ILLUSTRATED IN FIGURES

Figure 1:
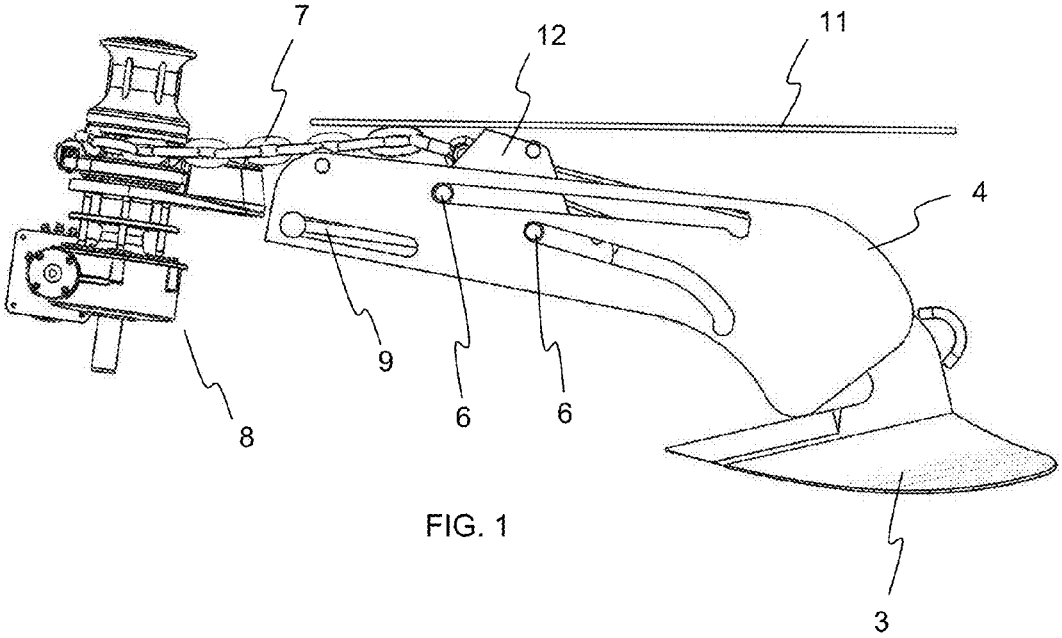
FIGS. 1 to 4 illustrate the stages as the anchor is at the initial position on the marine vehicle before dropped down into water and the following stages by which the anchor leaves the marine vehicle respectively.
Figure 2:
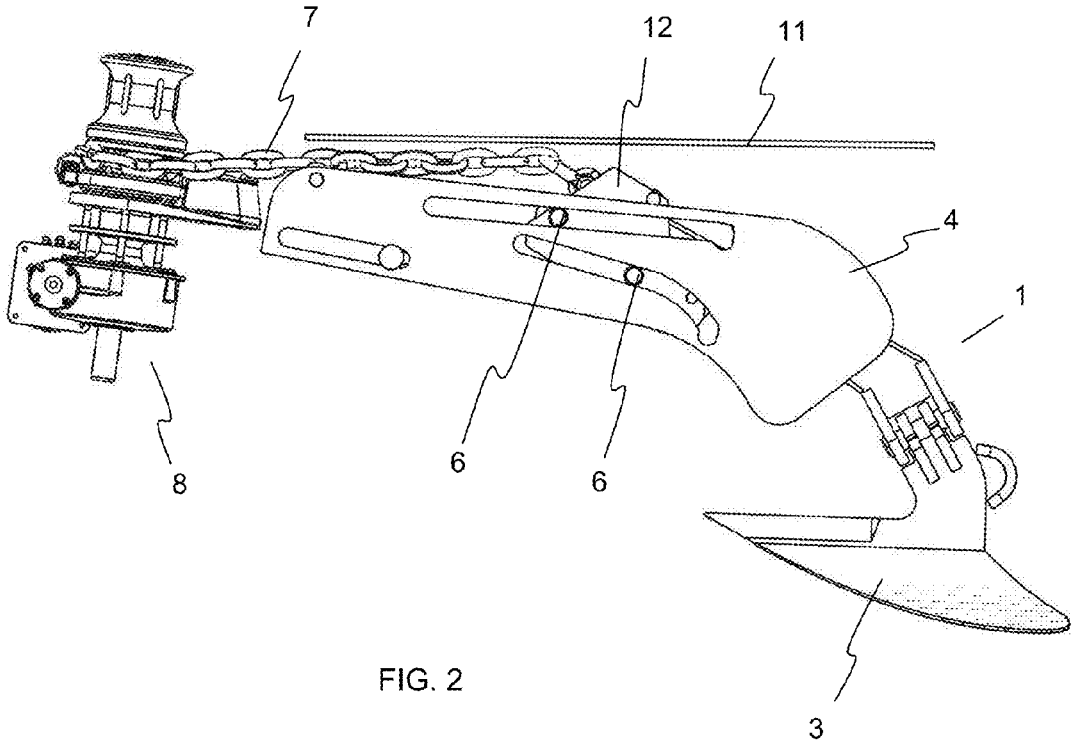
Figure 3:
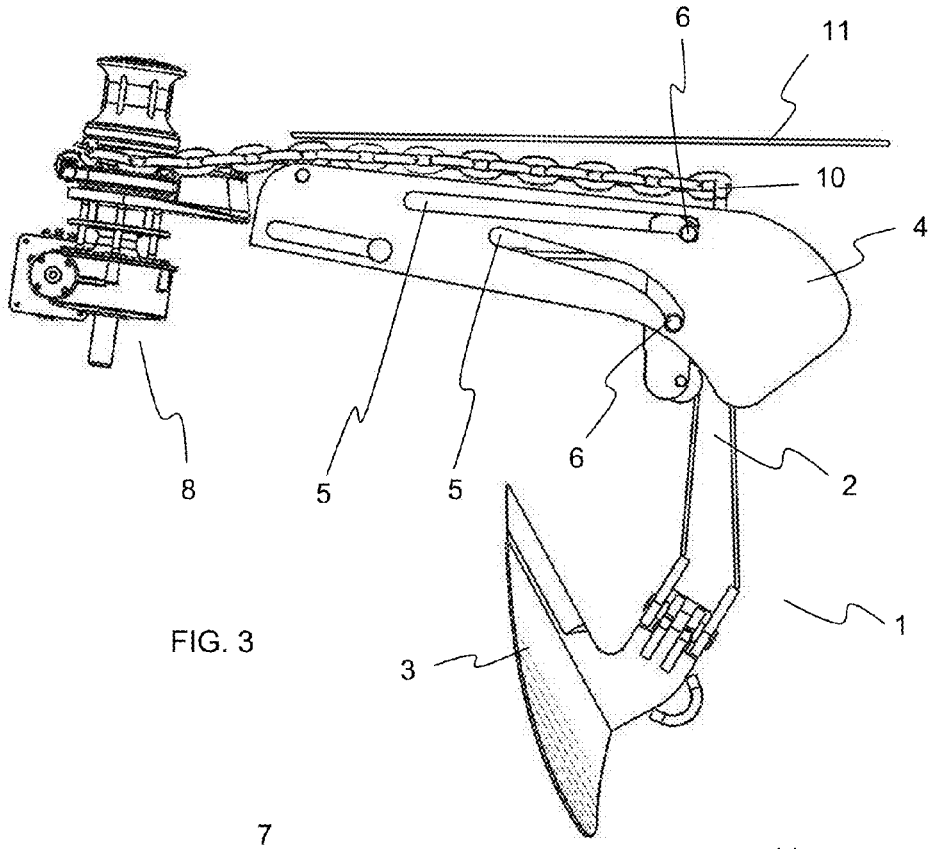
Figure 4:
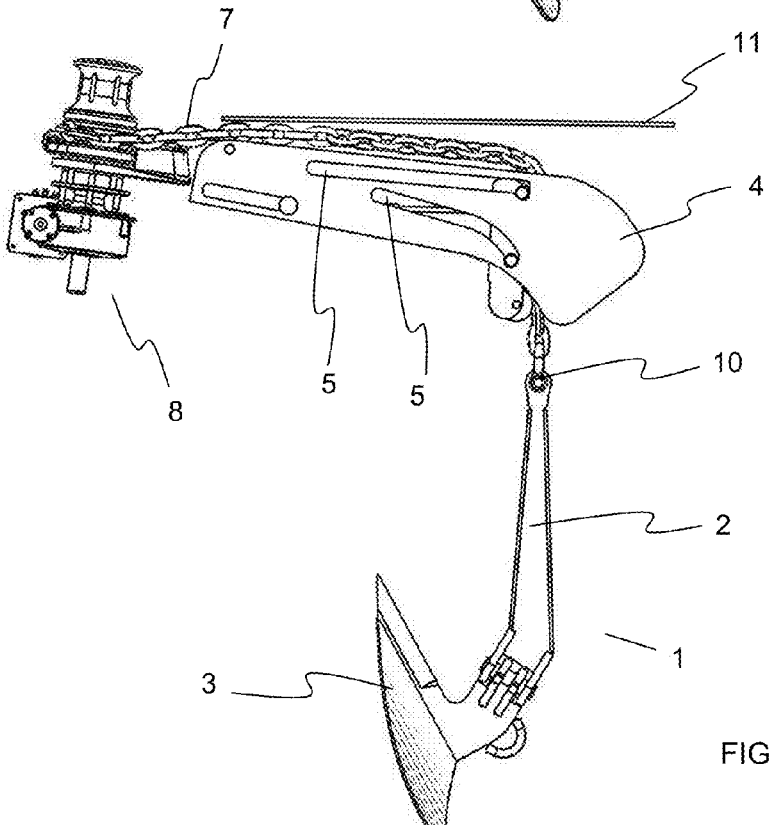

1 Anchor
2 Arm section of the anchor
3 Tip section of the anchor
4 Bearing
5 Bearing channel
6 Pin
7 Chain
8 Capstan
9 Piston
10 Chain connection end of the arm
11 Deck surface
12 Movable carrier
13 Reel
14 Bar

DESCRIPTION OF INVENTION

FIGS. 1 to 4 illustrate respectively the stages from the initial position corresponding to the retracted position of the anchor on the marine vehicle and to the position that the anchor is released down into the water. The anchor (1) comprises an arm section (2) with a longitudinal form, as well as a sharp pointed tip section (3), which holds the bottom of the sea, and is disposed underneath the deck surface (11). The chain connection end (10) of the arm (2) is connected to a chain (7), this chain (7) being released to the water and retracted back by means of a capstan (8), when needed.

Figure 5:
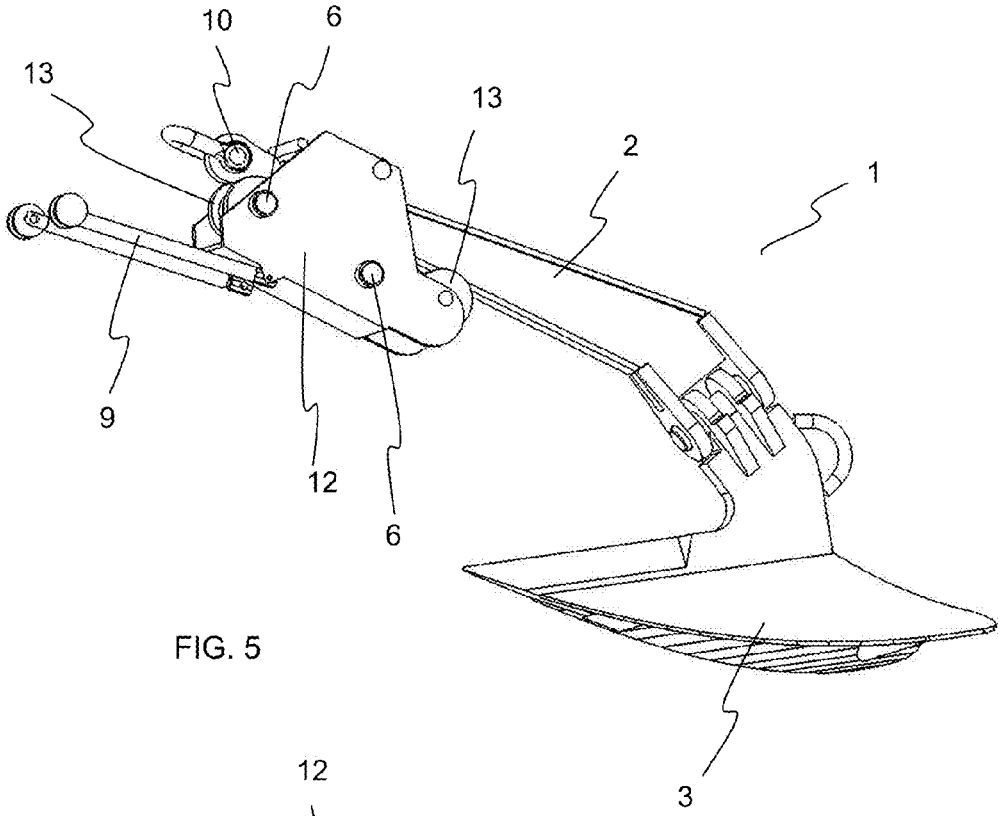
FIG. 5 is a perspective view of a movable carrier carrying the anchor.
Figure 6:
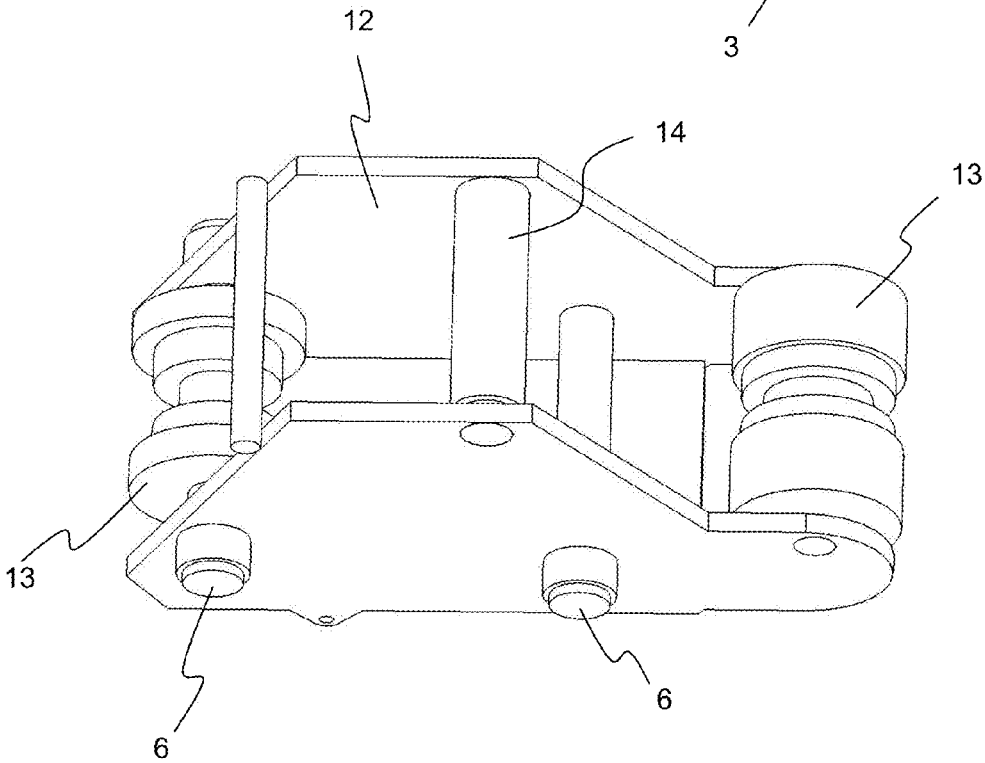
FIG. 6 is a perspective view of the upper side of a movable carrier carrying the anchor.

The arm section (2) of the anchor is held to be carried by a movable carrier (12) at a region close to the chain connection end (10). The movable carrier (12) comprises pins (6) being able to move in bearing channels (5) extending along the bearing's (4) longitudinal direction on the bearing, in compliance with the form of these channels (5). Whilst one of the bearing channels (5) is provided with a form that is in line with the longitudinal form of the bearing (4), the other one is preferably configured with a gradually-curved form; thus, the arm section of the anchor (2), which is carried by the movable carrier (12) and extends substantially on the horizontal direction initially (FIG. 1), is brought to a vertically-extending position at the final stage (FIG. 5).

While the anchor (1) is carried by the movable carrier (12) in the bearing (4), the arm section of the anchor (2) is supported from below by means of reels (13) disposed in the movable carrier (12). Thus, a relatively easy movement is provided while the anchor (1) is dropped down to and picked up from the water, and these parts are prevented from mechanical friction of the bearing (4) and the movable carrier (12) so as to protect them against wearing.

The movable carrier (12) is driven by means of a drive element such as a piston (9) as shown in the figures. While the anchor (1) is released from the marine vehicle to the water, the piston (9) pushes the movable carrier (12) and enables the pins (6) to move along the bearing channels (5), and while the anchor (1) is retracted, the chain connection end of the arm is caught or held in an aperture left between the reel (13) shafts in the movable carrier (12) and a bar (14) extending at the transverse direction on the upper part of the movable carrier (12), as the chain (7) pulls the anchor (1), so that the movable carrier (12) is brought back to the initial position (the position in FIG. 1).

This completes the description of the preferred and alternate embodiments of the invention. Those skilled in the art may recognize other equivalents to the specific embodiment described herein which equivalents are intended to be encompassed by the claims attached hereto.

What is claimed is:

1. A mechanism for guiding an anchor on a boat, said anchor having a tip section (3) and an arm section (2) connected to the tip section (3), said mechanism comprising:

(a) an anchor bearing (4) having bearing channels (5), one bearing channel extending longitudinally along the bearing (4), and another bearing channel extending to have a curved form on the bearing (4);

(b) a movable anchor carrier (12) having opposing, protruding pins (6) thereon, the pins (6) extending into the bearing channels (5) thereby capturing said carrier within said bearing (4), said movable anchor carrier being movable along the channels, the movable anchor carrier (12) further having reels (13) for guiding said arm section into said carrier;

(c) a drive element (9) for driving the movable anchor carrier (12) along the bearing channels (5); and (d) a chain (7) having two ends, connected at one end to said arm section (2) and at the other chain end to a capstan (8).

2. A mechanism according to claim 1, wherein the drive element (9) comprises a piston.

* * * * *